US007150281B2

(12) United States Patent
Han

(10) Patent No.: US 7,150,281 B2
(45) **Date of Patent: *Dec. 19, 2006**

(54) CONFORMABLE ARTIFICIAL FINGERNAIL AND METHOD OF MAKING SAME

(75) Inventor: Kyu Sang Han, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 47 days.

This patent is subject to a terminal disclaimer.

(21) Appl. No.: 10/348,718

(22) Filed: Jan. 22, 2003

(65) Prior Publication Data

US 2006/0191551 A1 Aug. 31, 2006

Related U.S. Application Data

(63) Continuation-in-part of application No. 10/281,500, filed on Oct. 28, 2002, now abandoned.

(51) Int. Cl.
*A45D 29/00* (2006.01)

(52) U.S. Cl. ..... 132/73

(58) Field of Classification Search ..... 132/73, 132/73.5, 285

See application file for complete search history.

(56) References Cited

U.S. PATENT DOCUMENTS

| | | | | |
|---|---|---|---|---|
| 1,135,382 A | | 4/1915 | Kindred | |
| 2,199,207 A | | 4/1940 | Nolan | |
| 2,234,657 A | | 3/1941 | Smaldone | 132/73 |
| 2,239,040 A | | 4/1941 | Holmes | 132/73 |
| 2,607,356 A | | 8/1952 | Lewis | |
| 3,502,088 A | * | 3/1970 | Jarby | 132/73 |
| 4,034,769 A | * | 7/1977 | Nishimura | 132/76.4 |
| 4,222,399 A | | 9/1980 | Ionescu | |
| 4,511,608 A | | 4/1985 | Ferraro | |
| 4,577,648 A | | 3/1986 | Dinerstein et al. | 132/73 |
| 4,632,134 A | | 12/1986 | Reid | |
| 4,671,305 A | | 6/1987 | Mann | |
| 4,745,934 A | | 5/1988 | Mast et al. | |
| 4,751,935 A | | 6/1988 | Mast et al. | |
| 4,767,648 A | | 8/1988 | Hokama et al. | |
| 4,824,702 A | | 4/1989 | Straub | |
| 4,860,774 A | | 8/1989 | Becker | |
| 4,876,121 A | | 10/1989 | Cohen | |
| 4,884,680 A | | 12/1989 | Israel et al. | |
| 4,920,991 A | | 5/1990 | Shibahashi et al. | |
| 4,943,462 A | * | 7/1990 | Komerska et al. | 428/41.3 |
| 5,044,384 A | | 9/1991 | Hokama et al. | |
| 5,150,726 A | | 9/1992 | Rucker | 132/73 |
| 5,415,903 A | | 5/1995 | Hoffman et al. | |
| 5,638,835 A | | 6/1997 | Franz et al. | |
| 5,638,837 A | | 6/1997 | Juhl et al. | 132/73 |

(Continued)

FOREIGN PATENT DOCUMENTS

| | | |
|---|---|---|
| GB | 2 352 628 | 2/2001 |

(Continued)

*Primary Examiner*—John J. Wilson
*Assistant Examiner*—Robyn Doan
(74) *Attorney, Agent, or Firm*—Collard & Roe, P.C.

(57) ABSTRACT

An artificial fingernail and method of making an artificial fingernail is provided in which the artificial fingernail is adapted to conform to varying finger sizes and shapes. In one aspect, the artificial fingernail includes a polymeric body having a fingernail shape with an upper and a lower surface. A layer of deformable material is applied to at least a portion of the lower surface. The layer of deformable material is adapted to conform to an upper surface of a natural fingernail when applied to the natural fingernail.

18 Claims, 3 Drawing Sheets

U.S. PATENT DOCUMENTS

| | | | | | |
|---|---|---|---|---|---|
| 5,645,090 | A | | 7/1997 | Juhl et al. | 132/73 |
| 5,699,813 | A | | 12/1997 | Carroll | |
| 5,782,248 | A | | 7/1998 | Chang | 132/73 |
| 5,860,429 | A | * | 1/1999 | Chang | 132/73 |
| 5,901,714 | A | | 5/1999 | Benkart | 132/73 |
| 5,908,035 | A | * | 6/1999 | Carroll et al. | 132/73 |
| 5,927,293 | A | * | 7/1999 | Halpern | 132/200 |
| 5,944,027 | A | | 8/1999 | Chang | |
| 5,964,977 | A | * | 10/1999 | Sirdesai et al. | 156/280 |
| 6,042,679 | A | | 3/2000 | Holt et al. | |
| 6,196,234 | B1 | | 3/2001 | Gifford | |
| 6,303,140 | B1 | * | 10/2001 | Dever et al. | 424/443 |
| 6,328,039 | B1 | * | 12/2001 | Chang | 132/73 |
| 6,382,217 | B1 | | 5/2002 | Coker et al. | |
| 6,394,100 | B1 | | 5/2002 | Chang | |
| 2005/0022834 | A1 | | 2/2005 | Hwang | |

FOREIGN PATENT DOCUMENTS

| | | |
|---|---|---|
| JP | 5-56007 | 7/1993 |
| KR | 0130038 | 11/1997 |

* cited by examiner

CONFORMABLE ARTIFICIAL FINGERNAIL AND METHOD OF MAKING SAME

CROSS-REFERENCE TO RELATED APPLICATIONS

This application is a Continuation-In-Part of U.S. Ser. No. 10/281,500 filed Oct. 28, 2002.

BACKGROUND OF THE INVENTION

1. Field of the Invention

The present invention relates to artificial fingernails and in particular to an artificial fingernail adapted to conform to varying finger sizes and shapes and a method of making same.

2. The Prior Art

The prior art contains many patents directed to artificial fingernails or other natural fingernail coverings and methods of applying them using various forms of adhesives. See, e.g. U.S. Pat. No. 4,632,134 to Reid; U.S. Pat. No. 4,671,305 to Mann; U.S. Pat. Nos. 4,745,934 and 4,751,935 to Mast et al.; U.S. Pat. No. 4,767,648 to Hokama et al.; U.S. Pat. No. 4,943,462 to Komerska et al.; U.S. Pat. No. 5,638,835 to Franz et al.; U.S. Pat. No. 5,699,813 to Carroll; and U.S. Pat. No. 6,394,100 to Chang.

Artificial fingernails are typically made of acrylonitrile-butadiene-styrene (ABS) plastic. ABS plastic is useful because it bonds with nail glue and is readily dissolved by acetone which facilitates nail removal. However, ABS plastic cracks easily and is relatively inflexible which prevents the artificial nail from conforming to a particular user's finger. As a result, artificial fingernails are made in a variety of sizes. However, fingernail shapes are different, and it is impractical to make nails to accommodate the various shapes for each customer. Instead, artificial fingernails are typically sold in standard sets by size and length, but these sets cannot precisely fit all people.

Another drawback with known artificial fingernails is that their appearance is usually readily distinguishable from natural nails. Generally, the better the artificial fingernail fits at the cuticle area, the more the artificial fingernail will resemble a natural nail. Achieving this fit with artificial fingernails, however, is difficult and often requires considerable skill in shaping and filing the artificial fingernail.

To address the problem of making an artificial fingernail accommodate a specific user's hand, U.S. Pat. No. 6,196,234 to Gifford and U.S. Pat. No. 6,382,217 to Coker et al. make a mold from the user's hand with which to construct a custom-made artificial fingernail. These processes are complicated, and there is still a need for an artificial fingernail that is more universally conformable to varying finger sizes and shapes.

SUMMARY OF THE INVENTION

An artificial fingernail which is adapted to conform to varying finger sizes and shapes and a method of making an artificial fingernail are provided. The artificial fingernail includes a polymeric body having a fingernail shape with an upper surface and a lower surface. A layer of deformable material is applied to at least a portion of the lower surface. The deformable material layer is adapted to conform to an upper surface of a natural fingernail when applied to the natural fingernail.

In one aspect, the polymeric body has a front distal part and a back proximal part and a layer of deformable material has a back proximal portion which extends beyond the back proximal part of the polymeric body and is adapted to conform to a cuticle portion of the wearer's finger and remain deformable when the artificial fingernail is worn by the wearer, the back proximal portion forming a portion of a top surface of the artificial fingernail without being covered by the polymeric body.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
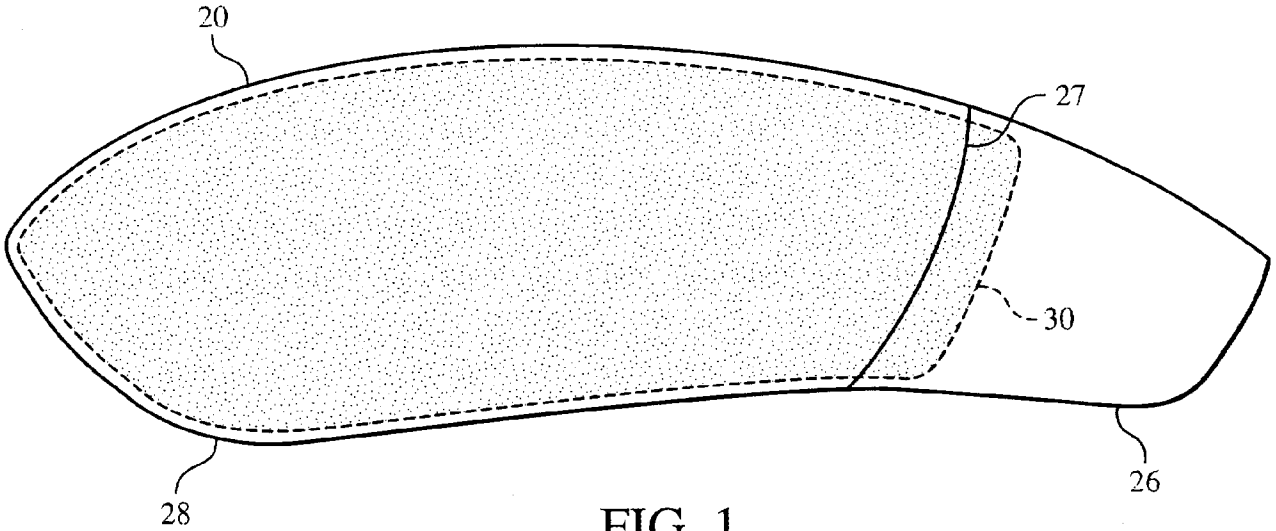
FIG. 1 is a top view of an embodiment of the artificial fingernail of the present invention.
Figure 2:
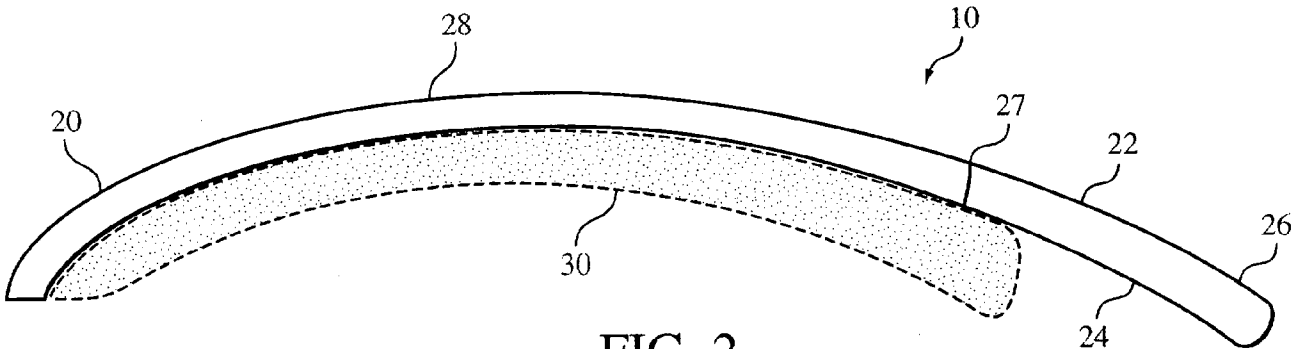
FIG. 2 is a side view of the embodiment of FIG. 1.

Turning now in detail to the drawings, FIGS. 1 and 2 show an artificial fingernail adapted to conform to varying finger sizes and shapes of a preferred embodiment. Artificial fingernail 10 includes a polymeric body 20 and a layer of deformable material 30.

Polymeric body 20 has the general overall shape and configuration of a natural fingernail with an upper surface 22 and a lower surface 24. Polymeric body 20 may be a conventional plastic artificial fingernail and is preferably made from a mixture of acrylonitrile-butadiene-styrene (ABS) plastic and a polycarbonate, but may be made from any plastic-like material commonly employed in the manufacture of artificial nails, such as ABS plastic, nylon, tenite acetate, vinyl acetate, polycarbonates, polyvinyl chloride, etc., using conventional injection molding techniques known in the art.

Polymeric body 20 has a front distal part 26 and a back proximal part 28 both of which may be transparent, translucent or opaque. Body 20 is preferably sized so that at least a portion of front distal part 26 extends from the wearer's natural fingernail. Front distal part 26 preferably has a different color than back proximal part 28 to provide an appearance of a "french tip" or french manicure in which front distal part 26 has a white or near-white appearance and back proximal part 28 has another color. Line 27 represents a french tip line separating front distal part 26 from back proximal part 28 and may be used as a guide or stop line to assist a user in applying nail polish to back proximal part 28, if desired. Thus, both front distal part 26 and back proximal part 28 may be molded from a translucent material simulating the natural color of a natural fingernail so that the user may apply a particular color nail polish to both portions or to only the back proximal part 28 to simulate the appearance of a natural nail done in the french manicure style.

Deformable material layer 30 is applied to at least a portion of lower surface 24 on the inside of polymeric body 20. Layer 30 is generally of uniform thickness, for example 0.8 mm to 1.0 mm, but may decrease in thickness (i.e. taper)

at the proximal end of back part 28 to facilitate attachment and blending with the natural fingernail and to conform to the contour of polymeric body 20. Layer 30 is adapted to conform to an upper surface of a natural fingernail when applied to the natural fingernail. The deformable material is preferably silicone, a silicone derivative, rubber or other material which will deform under pressure to conform to the contour of the wearer's natural fingernail. For example, material suitable for forming soft contact lenses such as silicone elastomers, silicone-containing macromers, hydrogels, silicone-containing hydrogels, siloxanes, siloxane macromers, and mixtures thereof may be used. The deformable material may be applied under polymeric body 20 by spray molding, double injection, manual application or any other suitable application.

Deformable material layer 30 preferably is applied to the inside of polymeric body 20 so as to extend underneath at least a portion of front distal part 26, i.e. past french tip line 27.

Artificial fingernail 10 may be readily manufactured in a number of standard sets by size and length as with conventional artificial fingernails. A user can then select the desired size and length that approximates the user's finger size and shape. However, unlike conventional artificial fingernails, due to the layer of deformable material applied to the lower surface, each artificial nail will conform more closely to the user's natural fingernail when applied thereto.

After selecting the artificial fingernail, the user applies a selected conventional adhesive, such as an ethylcyanoacrylate-based glue, to the natural fingernail. Artificial nail 10 is then placed on the natural fingernail so as to substantially cover it and pressure is applied by pressing down on artificial nail 10. Such pressure causes deformable layer 30 to compress and conform to the contour of the upper surface of the wearer's natural fingernail, thereby providing a better fit. If desired, once applied, artificial fingernail 10 may be trimmed and shaped using a nail file.

Figure 3:
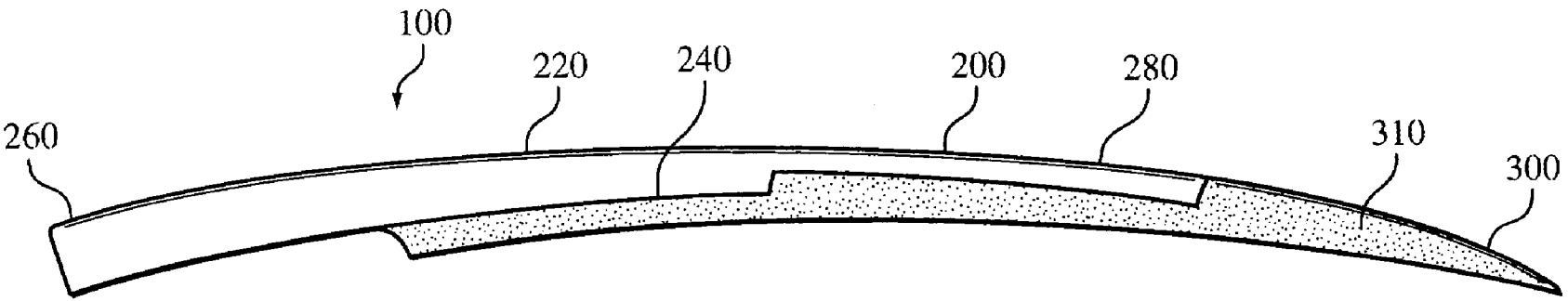
FIG. 3 is a side view of a second embodiment of the artificial fingernail of the present invention.
Figure 4:
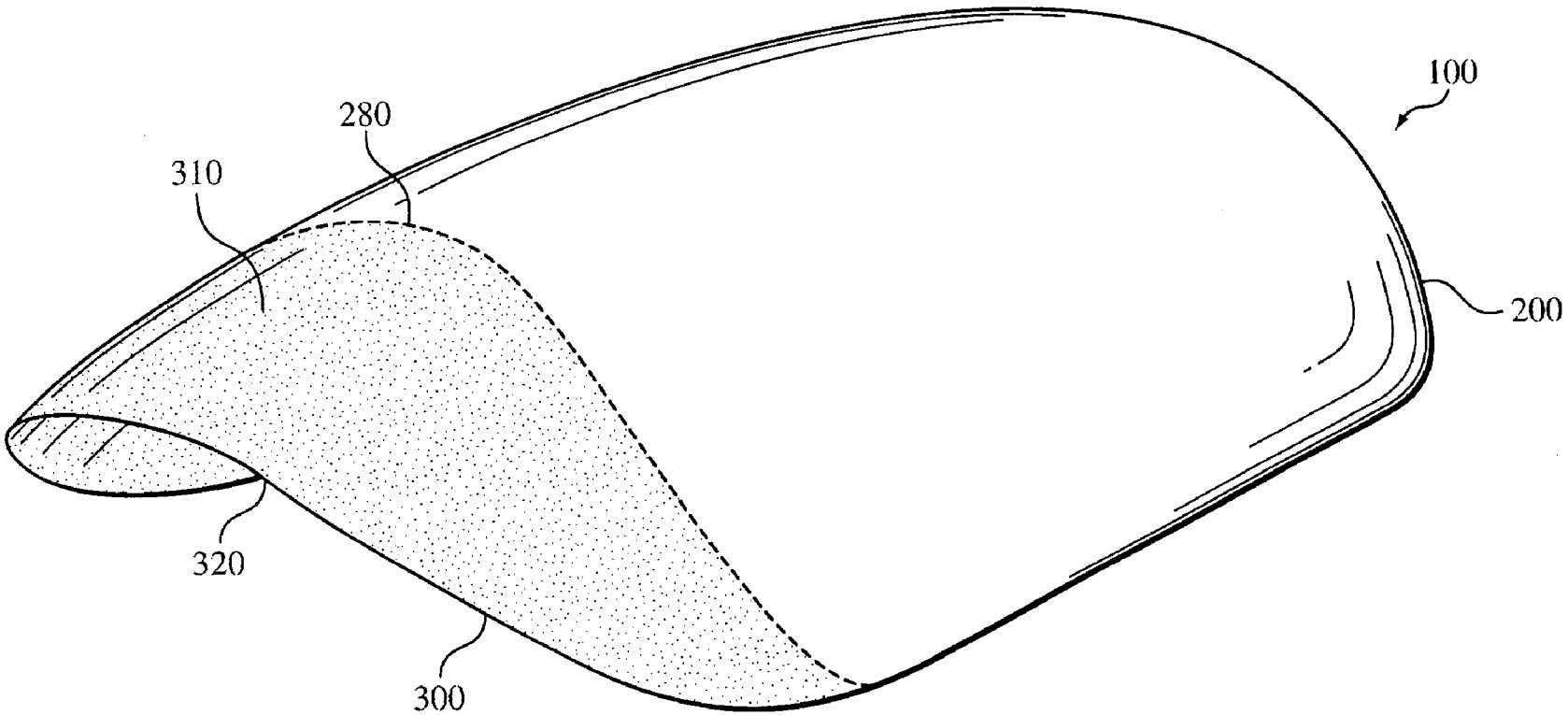
FIG. 4 is a perspective view of the embodiment of FIG. 3.

FIGS. 3 and 4 show a second preferred embodiment of an artificial fingernail adapted to conform to varying finger sizes and shapes. Artificial fingernail 100 includes a polymeric body 200 and a layer of deformable material 300.

Polymeric body 200 has the general overall shape and configuration of a natural fingernail with an upper surface 220 and a lower surface 240. Polymeric body may be made from the same material as polymeric body 20 of the first embodiment, using conventional injection molding techniques known in the art.

Polymeric body 200 has a front distal part 260 and a back proximal part 280, both of which may be transparent, transparent or opaque. Preferably, front distal part 260 has a greater thickness than back proximal part 280 as shown in FIG. 3. For example, front distal part 260 may be 1.0 mm to 5.0 mm in thickness and back proximal part 280 may be 0.8 to 1.0 mm in thickness.

Body 200 is preferably sized so that at least a portion of front distal part 260 extends from the wearer's natural fingernail. As in the first embodiment, front distal part 260 may also have a different color than back proximal part 280 and a french tip line may be provided to separate front distal part 260 from back proximal part 280.

Deformable material layer 300 is applied to at least a portion of lower surface 240 on the inside of polymeric body 200. Preferably, layer 300 has a back proximal portion 310 which extends beyond back proximal part 280 as shown in FIG. 3. Layer 300 has a cuticle contact area having a curved "half-moon" edge 320 shown in FIG. 4 which is adapted to conform to a cuticle portion of the wearer's finger.

Back proximal portion 310 is designed to be disposed between polymeric body 200 and the wearer's cuticle so that back proximal part 310 contacts the cuticle area and forms a portion of the top surface of artificial nail 100. The remaining top surface is formed by polymeric body 200 as shown in FIGS. 3 and 4. In this way, artificial nail 100 is more flexible in the critical cuticle area and is more easily adjustable and less likely to crack.

As in the first embodiment, layer 300 may be generally of uniform thickness, for example 0.8 to 1.0 mm, but may decrease in thickness at the proximal end of back proximal portion 310 to facilitate attachment and blending with the natural fingernail. Except for its proximal end, back proximal portion 310 preferably has a thickness in the range of 0.8 mm to 1.0 mm. Layer 300 is adapted to conform to an upper surface of a natural fingernail when applied to the natural fingernail. The deformable material may be the same material used for deformable layer 30 in the first embodiment and may be applied by similar application techniques to polymeric body 200. As in the first embodiment, deformable material layer 300 preferably is applied to the inside of polymeric body 200 so as to extend underneath at least a portion of front distal part 260 as shown in FIG. 3.

Artificial fingernail 100 may be readily manufactured in a number of standard sets by size and length as in the first embodiment.

After selecting the artificial fingernail, the user applies a selected conventional adhesive, such as an ethylcyanoacrylate-based glue, to the natural fingernail. Artificial fingernail 100 is then placed on the natural fingernail so as to substantially cover it and pressure is applied by pressing down on artificial fingernail 100. Such pressure causes deformable layer 300 to compress and conform to the contour of the upper surface of the wearer's natural fingernail and also to the cuticle area of the wearer's finger, thereby providing a better fit. If desired, once applied, artificial fingernail 100 may be trimmed and shaped using a nail file.

The artificial fingernail of the present invention has the further advantage of permitting polymeric body to be made from a wide variety of hard substances while also enabling the artificial fingernail to be easily removable by conventional acetone removers. Because the deformable layer contacts the wearer's fingernail, materials that do not readily dissolve in acetone may be used for the polymeric body without sacrificing ease of removability.

Although two embodiments of the present invention have been shown and described, it is to be understood that many changes and modifications may be made thereunto without departing from the spirit and scope of the invention as defined in the appended claims.

The invention claimed is:

1. An artificial fingernail adapted to conform to varying finger sizes and shapes which comprises:

(a) a polymeric body having a fingernail shape with an upper surface, a lower surface, a front distal part and a back proximal part; and (b) a layer of deformable material applied to at least a portion of said lower surface and having a back proximal portion extending beyond said back proximal part adapted to conform to an upper surface of a natural fingernail of a wearer's finger and to a cuticle portion of the finger and remaining deformable when the artificial fingernail is worn by the wearer;

wherein said back proximal portion forms a portion of a top surface of the artificial fingernail without being covered by said polymeric body.

2. The artificial fingernail according to claim 1 wherein said deformable material is rubber.

3. The artificial fingernail according to claim 1 wherein said deformable material is applied by spray molding, double injection or manual application.

4. The artificial fingernail according to claim 1 wherein said polymeric body is made from a mixture of acrylonitrile-butadiene-styrene (ABS) plastic and polycarbonate.

5. The artificial fingernail according to claim 1 wherein said front distal part has a different color than the back proximal part, and said layer of deformable material is applied to extend underneath at least a portion of said front distal part.

6. The artificial fingernail according to claim 1 wherein said layer of deformable material has a cuticle contact area having a curved edge adapted to contact the cuticle portion of the wearer's finger.

7. The artificial fingernail according to claim 1 wherein at least a portion of said layer of deformable material extending beyond said back proximal part has a thickness in a range of 0.8 mm to 1.0 mm.

8. The artificial fingernail according to claim 1 wherein said polymeric body is made from a material selected from the group consisting of acrylonitrile-butadiene-styrene (ABS) plastic, polyvinyl chloride, and nylon.

9. The artificial fingernail according to claim 1 wherein said deformable material is selected from the group consisting of silicone, rubber, and silicone derivatives.

10. A method of making an artificial fingernail adapted to conform to varying finger sizes and shapes, which comprises:

(a) providing a polymeric body having a fingernail shape with an upper surface, a lower surface, a front distal part and a back proximal part; and (b) applying a layer of deformable material to at least a portion of said lower surface so as to have a back proximal portion extending beyond said back proximal part adapted to conform to an upper surface of a natural fingernail of a wearer's finger and to a cuticle portion of the finger and remaining deformable when the artificial fingernail is worn by the wearer, the back proximal portion forming a portion of a top surface of the artificial fingernail without being covered by the polymeric body.

11. The method according to claim 10 wherein said deformable material is rubber.

12. The method according to claim 10 wherein said deformable material is applied by spray molding, double injection or manual application.

13. The method according to claim 10 wherein said polymeric body is made from a mixture of acrylonitrile-butadiene-styrene (ABS) plastic and a polycarbonate.

14. The method according to claim 10 wherein said front distal part has a different color than the back proximal part, and said layer of deformable material is applied to extend underneath at least a portion of said front distal part.

15. The method according to claim 10 wherein said layer of deformable material has a cuticle contact area having a curved edge adapted to contact the cuticle portion of the wearer's finger.

16. The method according to claim 10 wherein at least a portion of said layer of deformable material extending beyond said back proximal part has a thickness in a range of 0.8 mm to 1.0 mm.

17. The method according to claim 10 wherein said polymeric body is made from a material selected from the group consisting of acrylonitrile-butadiene-styrene (ABS) plastic, polyvinyl chloride, and nylon.

18. The method according to claim 10 wherein said deformable material is selected from the group consisting of silicone, rubber and silicone derivatives.

* * * * *